US007015867B1

(12) United States Patent
Miller et al.

(10) Patent No.: US 7,015,867 B1
(45) Date of Patent: Mar. 21, 2006

(54) ILLUMINATING REFLECTOR WITH LOW-GAIN PROPAGATOR

(75) Inventors: Julie Miller, Auberry, CA (US); William J. Taft, Yardville, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/812,535

(22) Filed: Mar. 29, 2004

(51) Int. Cl.
*H01Q 13/00* (2006.01)
*H01Q 19/10* (2006.01)

(52) U.S. Cl. ..... 343/781 P; 343/781 CA; 343/755

(58) Field of Classification Search ..... 343/781 P, 343/781 CA, 781 R, 909, 756, 753, 754, 343/755
See application file for complete search history.

(56) References Cited

U.S. PATENT DOCUMENTS 5,373,302 A * 12/1994 Wu ..... 343/781 P
6,252,559 B1 * 6/2001 Donn ..... 343/781 CA
2004/0108961 A1 * 6/2004 Hay et al. ..... 343/781 CA

OTHER PUBLICATIONS

S. Shambayati, "On the Use of W-Band for Deep-Space Communications", IPN Progress Report 42-154, Aug. 15, 2003, pp. 1-17.

* cited by examiner

*Primary Examiner*—Hoang V. Nguyen
(74) *Attorney, Agent, or Firm*—McDermott Will & Emery LLP

(57) ABSTRACT

An illuminating-reflector system is provided for transmitting a frequency band in an dispersed beam and a substantially collimated beam. The system includes a secondary reflector configured to transmit a first portion of the frequency band to form the dispersed beam and to reflect a second portion of the frequency band; and a primary reflector configured to receive the second portion of the frequency band reflected from the secondary reflector and to reflect the second portion of the frequency band to form the substantially collimated beam.

41 Claims, 8 Drawing Sheets

ILLUMINATING REFLECTOR WITH LOW-GAIN PROPAGATOR

BACKGROUND OF THE INVENTION

The present invention relates to satellite communication systems. More particularly the present invention relates to an illuminating reflector having a low-gain propagator that provides cross-link communications with other satellites.

Modern satellites provide high bandwidth communications for military applications, telecommunications, and television as well as others fields. Costs associated with launching satellites into Earth orbits increase significantly in proportion to increased satellite weight. Accordingly, one goal of satellite manufacturers is to manufacture satellites as light as feasibly possible while continuing to provide high bandwidth communications.

A traditional satellite in cross-communication with other satellites typically transmit a frequency band through two transmitters. The frequency band is typically transmitted as an dispersed beam by a first transmitter and as a collimated beam by a second transmitter. FIG. 1 shows an example of a typical satellite 100 having a first transmitter 105 configured to transmit a frequency band in an dispersed beam 110 and a second transmitter 115 configured to transmit the frequency band in a collimated beam 120. The dispersed beam may be used by a satellite 125 for initially acquiring the dispersed beam and for tracking the dispersed beam to lock onto and collect the collimated beam, which may be a modulated beam. Because two transmitters are typically used to transmit dispersed and collimated beams, additional weight is added to the traditional satellite that raises the cost of launch as well as the cost of design and manufacture.

Accordingly, there is a need for satellites that are light, and yet are capable of transmitting frequency bands in dispersed and collimated beams for satellite and terrestrial acquisition and communication.

BRIEF SUMMARY OF THE INVENTION

The present invention provides a satellite communication system. More particularly the present invention provides an illuminating reflector having a low-gain propagator that provides cross-link communications with other satellites.

According to one embodiment, an illuminating-reflector system is provided for transmitting a frequency band in an dispersed beam and a substantially collimated beam, the system includes a secondary reflector configured to transmit a first portion of the frequency band to form the dispersed beam and to reflect a second portion of the frequency band; and a primary reflector configured to receive the second portion of the frequency band reflected from the secondary reflector and to reflect the second portion of the frequency band to form the substantially collimated beam. According to a specific embodiment, the system further includes a dispersive lens configured to receive the frequency band from a beam waveguide and transmit the frequency band to the secondary reflector in another dispersed beam. According to another specific embodiment, the dispersed beam is configured to be acquired by a satellite for initial acquisition and automatic tracking of the system.

According to another embodiment, a satellite is provided for cross-link communications with at least one other satellite. The satellite including an illuminating reflector configured to transmit a first portion of a frequency band in a collimated beam and a second portion of a frequency band in an dispersed beam. According to a specific embodiment, the dispersed beam is a low-gain beam. According to another specific embodiment, the collimated beam is a high-gain beam. According to another specific embodiment, the illuminating reflector includes: a secondary reflector configured to transmit the first portion of the frequency band to form the dispersed beam and to reflect a second portion of the frequency band; and a primary reflector configured to receive the second portion of the frequency band reflected from the secondary reflector and to reflect the second portion of the frequency band to form the substantially collimated beam.

According to another embodiment, a satellite communication method is provided for cross-linked communication between satellites. The method includes: at a first satellite: transmitting in an dispersed beam a first portion of a frequency band through a secondary reflector, wherein the secondary reflector is configured to form a portion of an illuminating reflector; reflecting a second portion of the frequency band from the secondary reflector; receiving at a primary reflector the second portion of the frequency band reflected from the secondary reflector, wherein the primary reflector is configured to form another portion of the illuminating reflector; and reflecting at the primary reflector the second portion of the frequency band to form a substantially collimated beam. According to a specific embodiment, the method further includes: at a second satellite: acquiring the dispersed beam; and tracking the dispersed beam to acquire the collimated beam. According to another specific embodiment, the primary reflector and the secondary reflector form a Cassegrain reflector.

Numerous benefits may be achieved using embodiments of the present invention over conventional techniques. For example, an embodiment of the invention provides for transmitting a frequency band in a dispersed beam and collimated beam by employing a single illuminating reflector. As a single illuminating reflector is provided for such transmissions, a satellite that includes the single illuminating reflector may be relatively light weight and, therefore, relatively inexpensive to manufacture and launch. Depending upon the specific embodiment, there can be one or more of these benefits. These and other benefits can be found throughout the present specification and more particularly below.

A further understanding of the nature and advantages of the present invention may be realized by reference to the remaining portions of the specification and the drawings.

DETAILED DESCRIPTION OF THE INVENTION

The present invention provides a satellite communication system. More particularly the present invention provides an illuminating reflector having a low-gain propagator that provides cross-link communications with other satellites.

Figure 1:
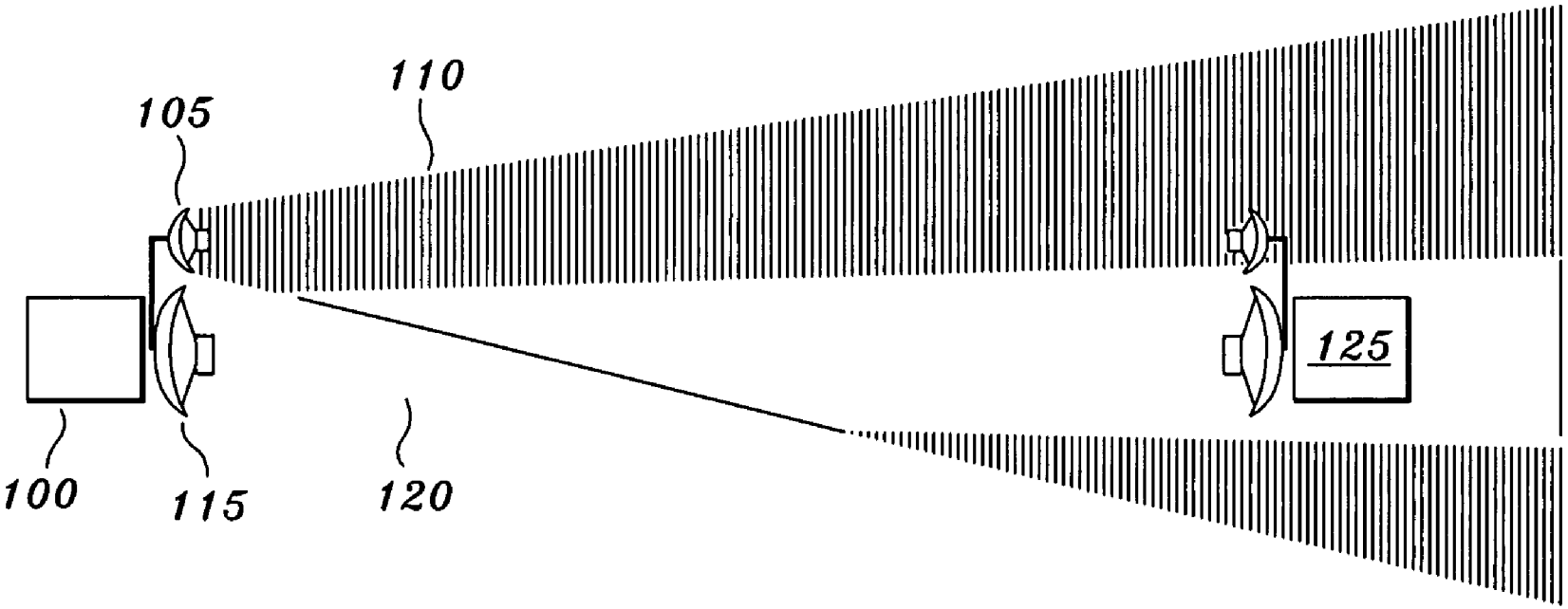
FIG. 1 (PRIOR ART)
FIG. 1 shows an example of a satellite having a first transmitter configured to transmit a frequency band in a dispersed beam and a second transmitter configured to transmit the frequency band in a collimated beam.
Figure 2:
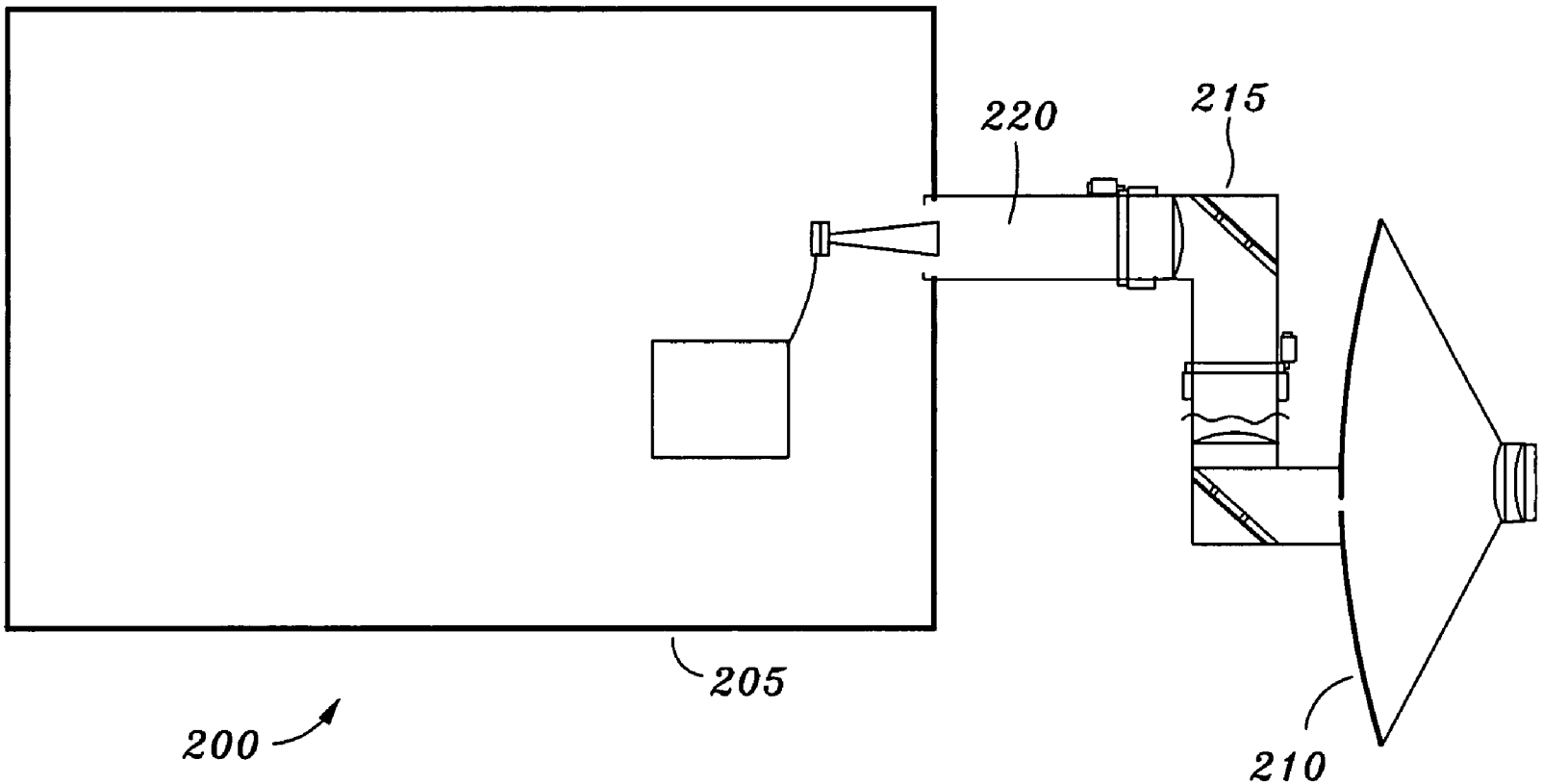
FIG. 2 is a simplified schematic of a satellite according to an embodiment of the present invention.

FIG. 2 is a simplified schematic of a satellite 200 according to an embodiment of the present invention. Satellite 200 includes a satellite bus 205 and an illuminating reflector 210. Satellite bus 205 is coupled to illuminating reflector 210 via a control arm 215. Control arm 215 may have one or more gimbals configured to rotate (or slew) illuminating reflector 210. Control arm 215 includes a beam waveguide 220 configured to deliver a frequency band (modulated or unmodulated) from the satellite bus to the illuminating reflector.

Figure 3:
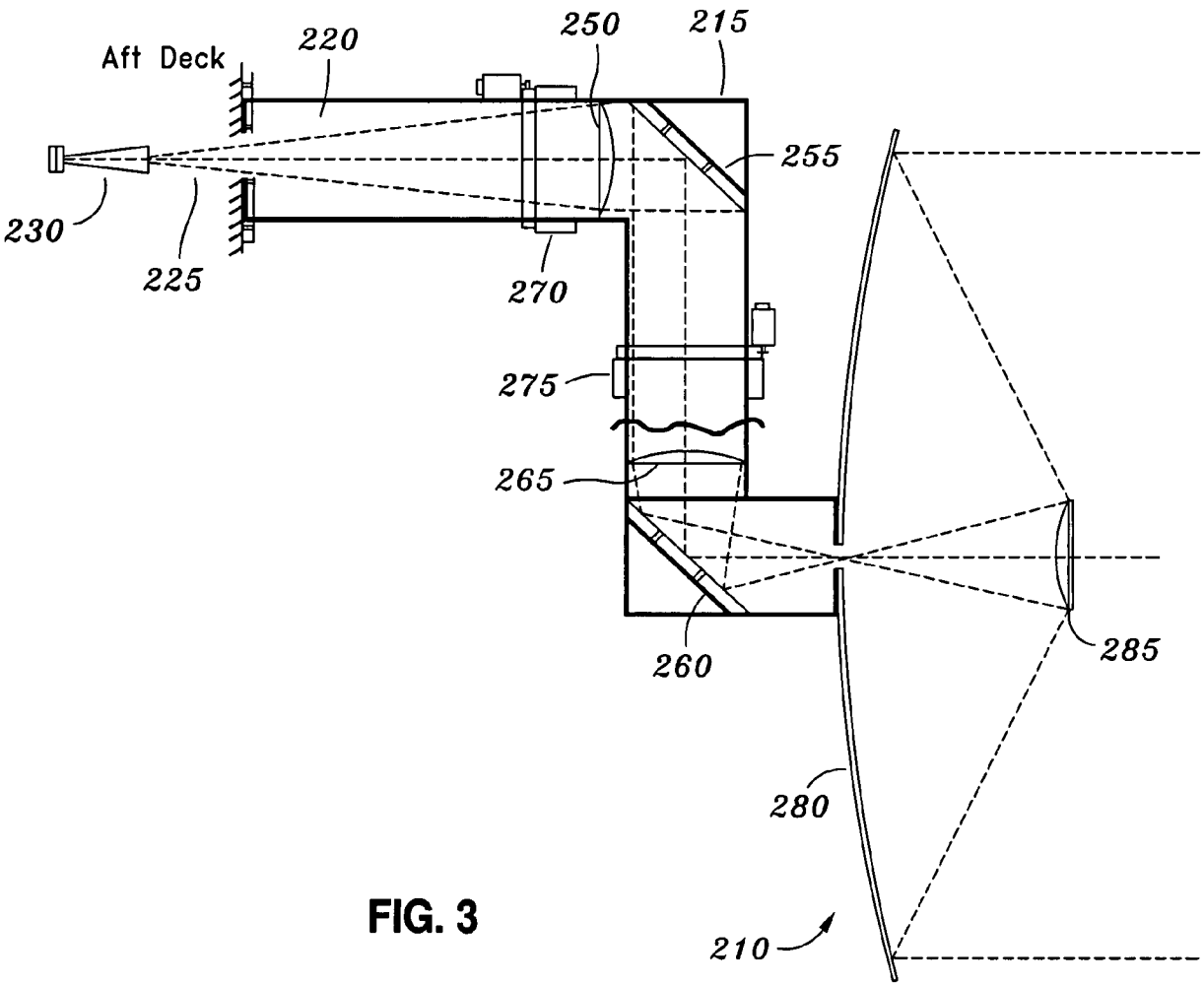
FIG. 3 is a detailed schematic of a control arm and an illuminating reflector according to an embodiment of the present invention.

FIG. 3 is a detailed schematic of control arm 215 and illuminating reflector 210 according to an embodiment of the present invention. The control arm and illuminating reflector may be coupled to an aft deck of the satellite bus and may be configured to receive a frequency band 225 from a feed horn 230. The frequency band may be the millimeter band, the microwave band, the Ka band, the V-band, C-band or other useful band. The V-band may include the Department of Defense V-band. The frequency band may be modulated for crosslink satellite communications. The frequencies of these bands may includes frequencies about 2 Ghz (gigahertz) to about 300 Ghz, inclusive.

Frequency band 225 may be collimated in the beam waveguide by a collimating lens 250. First and second flat reflectors 255 and 260, respectfully, may be configured to direct the frequency band through the beam waveguide. A lens 265, such as a converging lens, may be used to focus the collimated beam such that the frequency band exits the beam waveguide focused to a relatively small cross-sectional area. While, lens 265 is shown disposed between the reflectors 255 and 260, lens 255 may be disposed at a variety of locations within the beam waveguide, such as disposed between reflector 260 and the end of the beam waveguide. Two or more gimbals, such as gimbals 270 and 275, may be configured to variously slew illuminating reflector 210. For example, a beam waveguide having three or four ninety-degree bends may have three or four gimbals, respectively, to slew reflector 210 through $4\pi$ (or other) scan motion.

Figure 4A:
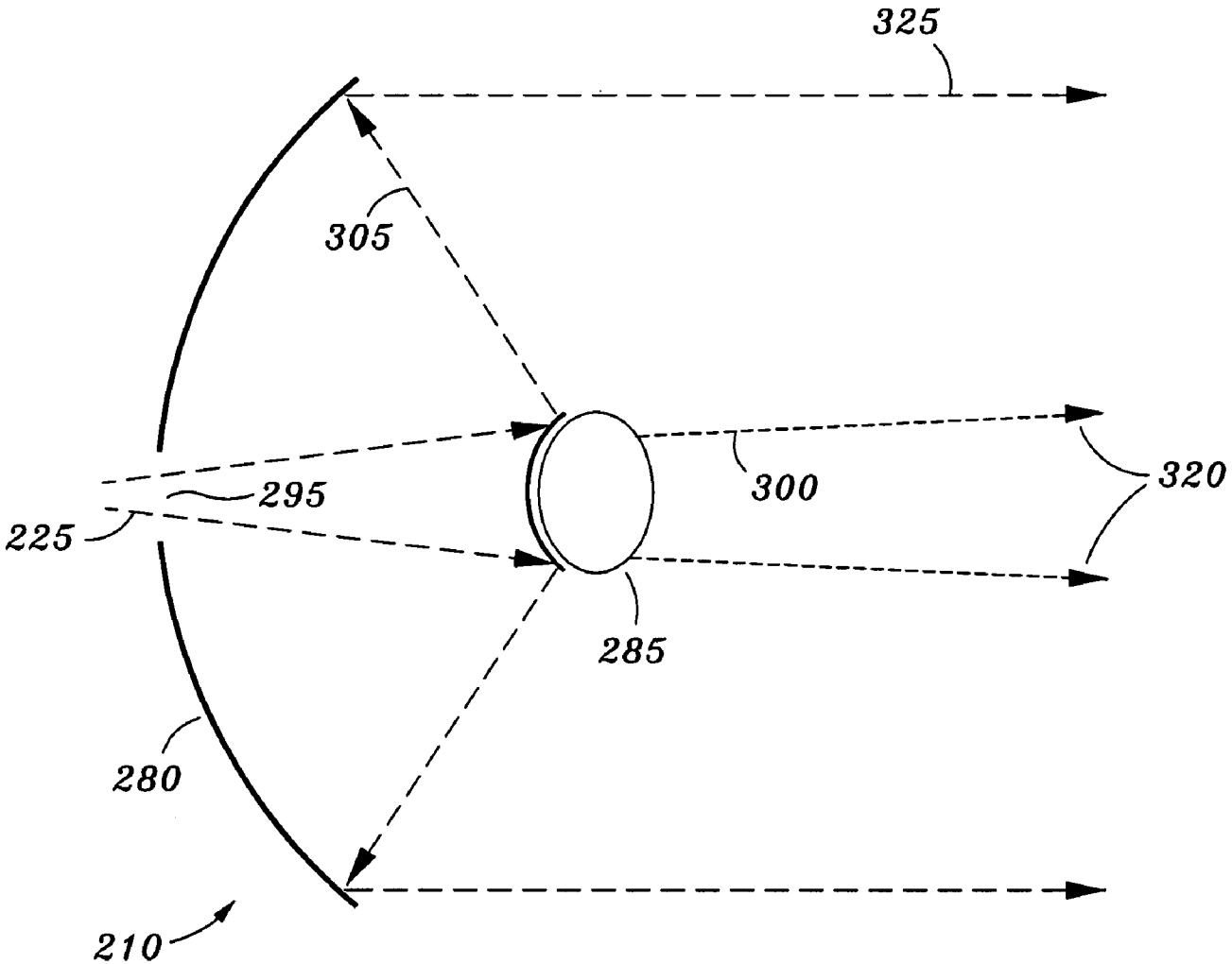
FIG. 4A is a further detailed schematic of the illuminating reflector according to an embodiment of the present invention.

FIG. 4A is a further detailed schematic of illuminating reflector 210 according to an embodiment of the present invention. Illuminating reflector 210 includes a primary reflector 280 a secondary reflector 285. Secondary reflector 285 is disposed optically upstream from primary reflector 280. The secondary reflector may be approximately at or within the focal plane of the primary mirror. Primary reflector 280 may be a parabolic mirror or the like and may have a diameter of about 5.5 feet or more. According to one embodiment, primary reflector 280 has a diameter of about 6 feet to about 8 feet, and according to a specific embodiment has a diameter of about 6 feet (or approximately two meters). The secondary reflector may be a concave or convex mirror and have a diameter of approximately 4 inches or greater, such as about 10 inches or about 12 inches. Primary reflector 280 and secondary reflector 285 may form a Cassegrain reflector, a Gregorian reflector or the like.

Frequency band 225, focused by lens 265, passes through an aperture 295 formed in the primary reflector 280. The frequency band diverges after passing through the aperture and is transmitted to secondary reflector 285. The frequency band at the secondary reflector may have a wavefront diameter approximately equal to or less than the diameter of the secondary reflector.

According to one embodiment, the secondary reflector is configured to transmit a first portion 300 of the frequency band and to reflect a second portion 305 of the frequency band. The secondary reflector transmit portion 300 such that the wavefronts of the transmitted potion travel in an dispersed beam 320. The dispersed beam may have a divergence angle of greater than or equal to about 0.5°. For example, the dispersed beam may have a divergence angle of about 1.5°. Reflected portion 305 of the frequency band is transmitted from the secondary reflector to the primary reflector and is reflected by primary reflector 280 in an essentially collimated beam 325.

Transmitted portion 300 of frequency band 225 in dispersed beam 320 may have a lower intensity than the reflected portion 305 of frequency band 225 in a substantially collimated beam 325. The dispersed beam may have, for example, approximately twenty percent or less of the power of the frequency band transmitted to the primary reflector and the reflected portion may have approximately eighty percent or more of the power of the frequency band transmitted to the secondary reflector. Primary reflector 280 may be characterized as a high-gain transmitter having, for example, a gain of 50 dBi or greater, such as about 59 dBi. According to a specific embodiment, the gain of the primary reflector is approximately 59.5 dBi. Secondary reflector 285 may be characterized as a low-gain reflector (or low-gain propagator) and may have a gain of approximately −20 dBi or less relative to the gain of the primary reflector. According to a specific embodiment, the gain of the secondary reflector may be about −33 dBi relative to the gain of the primary reflector.

Figure 4B:
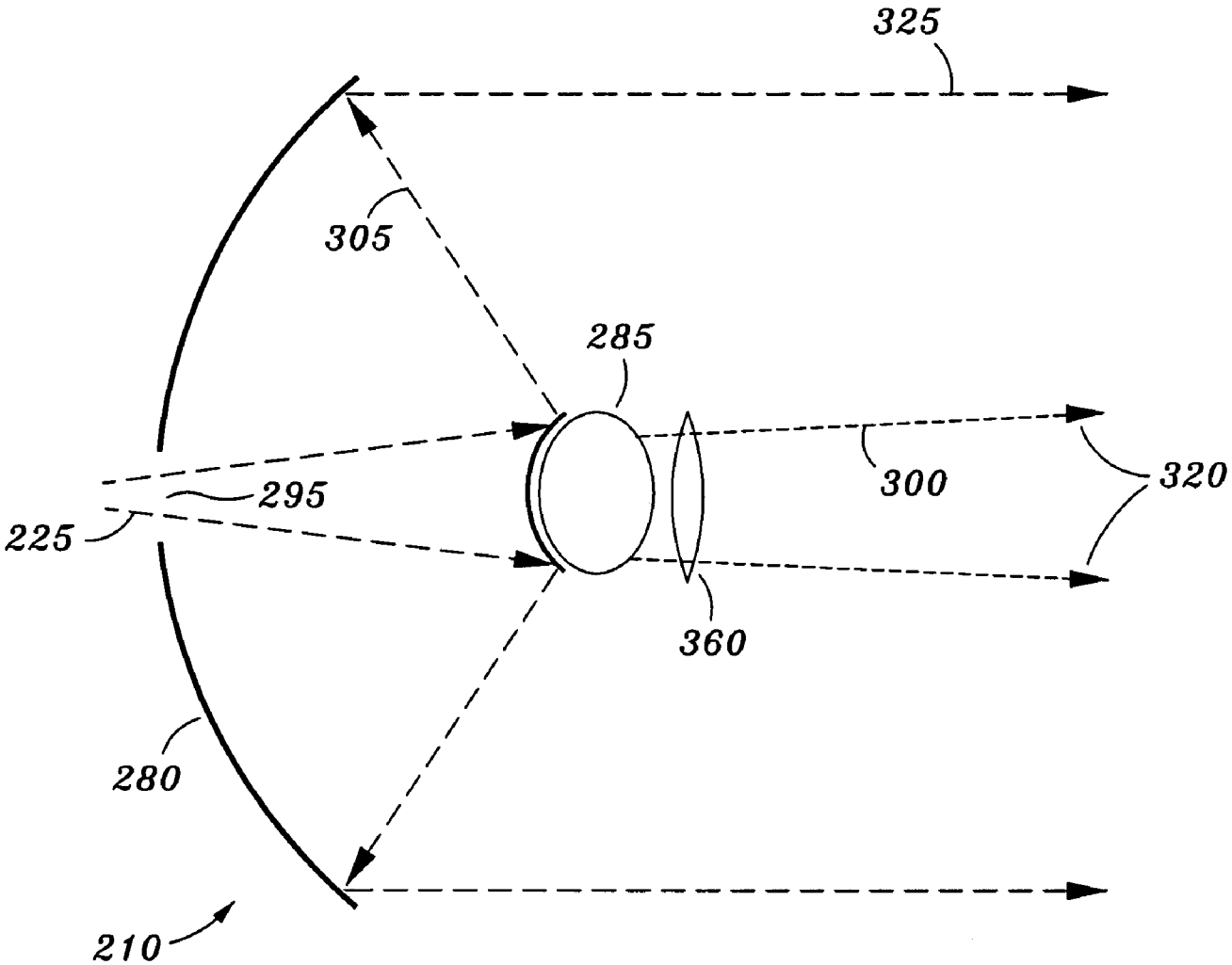
FIG. 4B is a further detailed schematic of the illuminating reflector according to another embodiment of the present invention.

The transmission and reflection properties of the secondary reflector may be achieved by appropriately coating one or more surfaces of the secondary reflectors. Methods for manufacturing partially transmissive coatings are well known to those of skill in the art and will not be discussed in detail. To control the beam width of dispersed beam 320, some embodiments include a dielectric lens 360, see for example FIG. 4B. While dielectric lens 360 is shown disposed in front of the secondary lens, dielectric lens 360 may be alternately disposed to control the dispersed-beam width.

Figure 5:
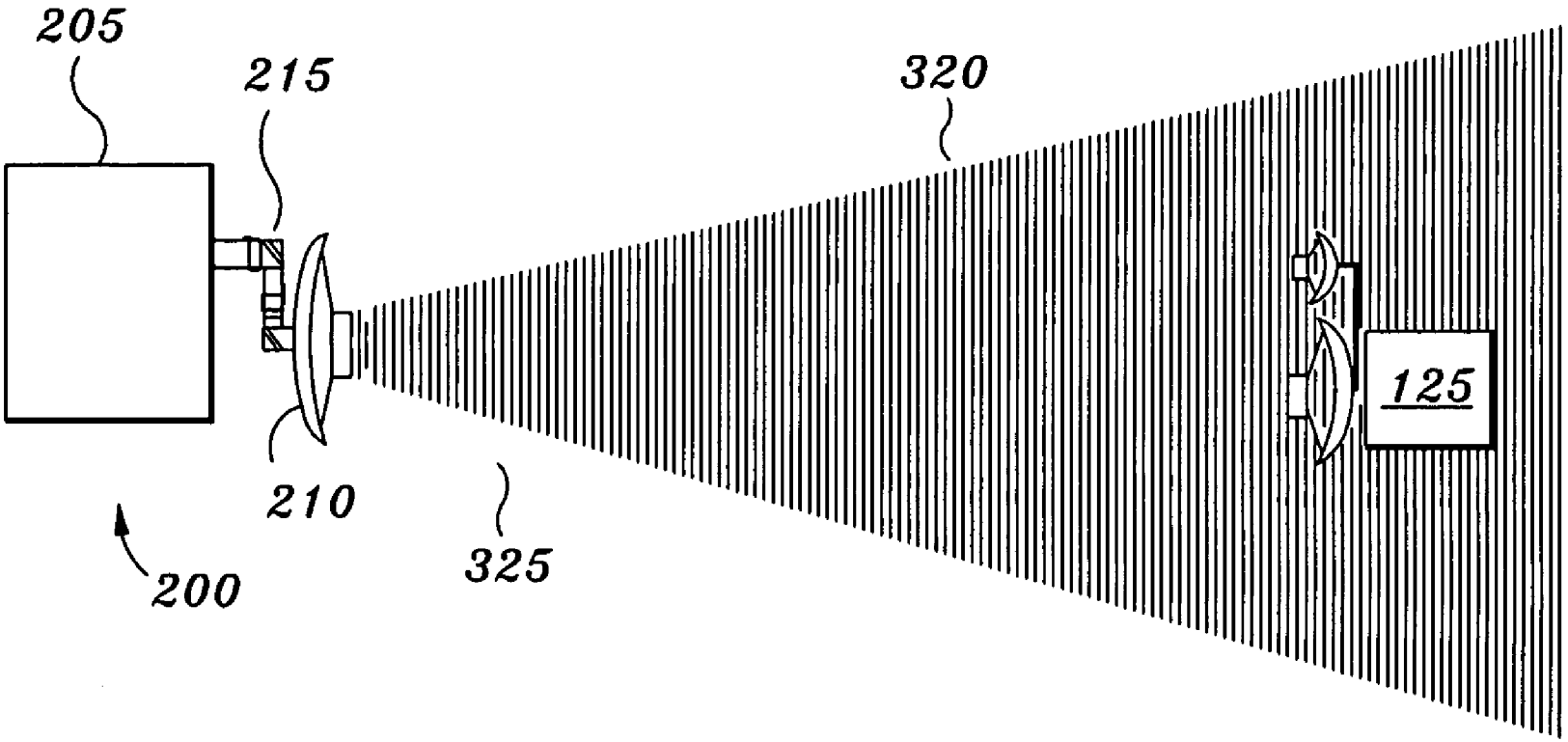
FIG. 5 is a diagram of a transmitting satellite and a receiving satellite in cross-communication according to an embodiment of the present invention.

Dispersed beam 320 may be configured to be received by a satellite, such as satellite 125 shown in FIG. 5, for initial acquisition of dispersed beam 320 and to track the dispersed beam to acquire collimated beams 325. According to one embodiment, the transmitted frequency band is un-modulated in acquisition mode. Once satellite 125 has acquired the collimated beam, a beacon signal may be transmitted by satellite 125 to satellite 200 signaling satellite 200 to modulate the frequency band for communication with satellite 125. According to an alternate embodiment, the frequency band may be modulated during acquisition by satellite 125.

According to one embodiment, control electronics 350 (see FIG. 2) for modulating the transmitted frequency band and for other control functions (e.g., gimbal control) are housed within satellite bus 205. Housing the control electronics within the satellite bus provides that the control electronics may be made relatively light. For example, relatively light shielding may be used to shield the control electronics as shielding from surrounding systems form a partial shield. In addition, relatively less hardening may be employed to shield the control electronics. Moreover, positioning the control electronics in the satellite bus provides that lighter, fewer, or no counter-rotating gyros need to be positioned near the illuminating reflector for damping momentum transfer between the illuminating reflector and satellite bus as the illuminating reflector is slewed or as the satellite but is rotated.

According to one embodiment, the mass of illuminating reflector 210 and control arm 215 (i.e., outboard mass) is less than about 150 pounds, and according to a specific embodiment is about 120 pounds or less. According to another embodiment, the combined weight of control electronics 350 and the outboard mass is about 250 pounds or less, and according to a specific embodiment is about 230 pounds or less.

Figure 6:
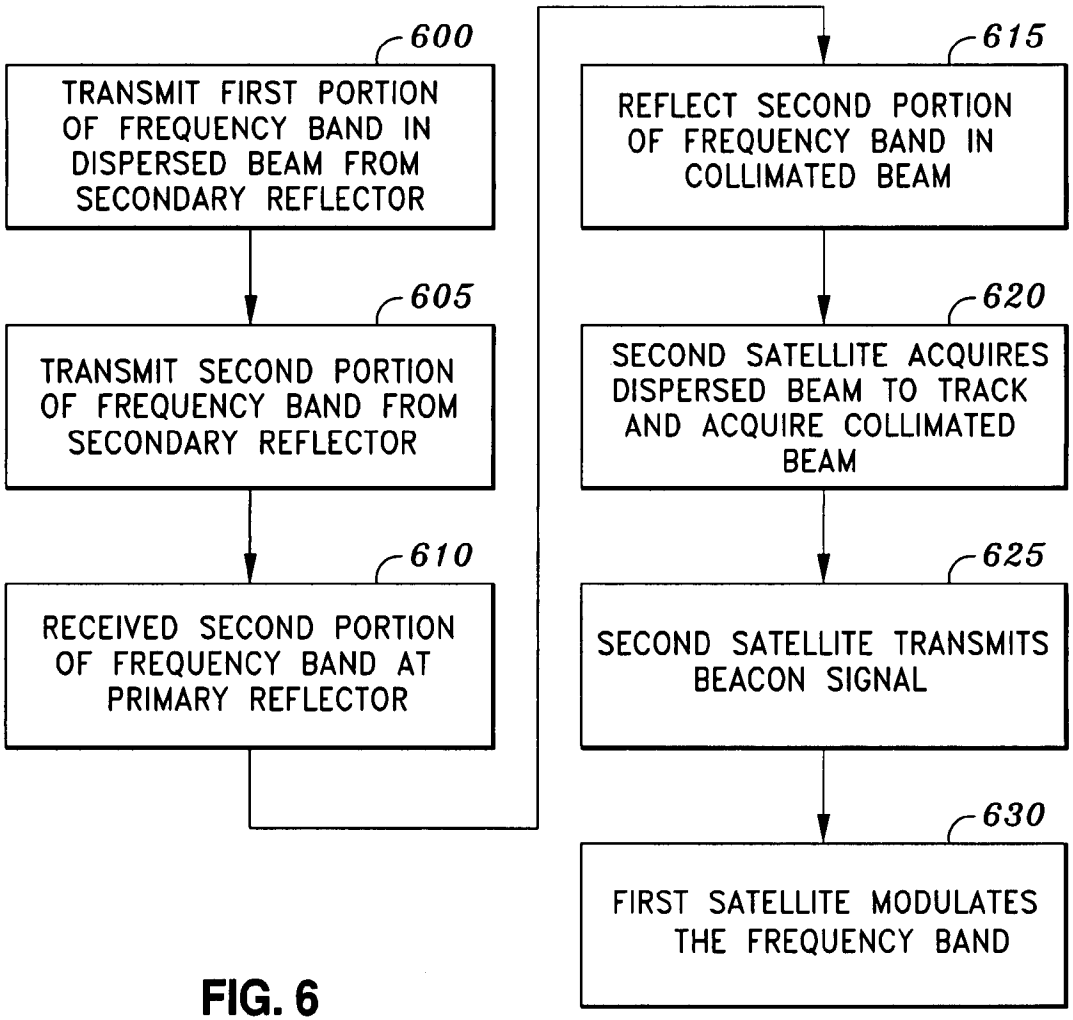
FIG. 6 is a high level flow chart having steps for satellite cross-communication according to an embodiment of the present invention.

FIG. 6 is a high-level flow chart having steps for cross-linked communication between satellites. It should be realized that the steps shown in FIG. 6 are not limiting on the invention as recited in the claims. Other techniques having fewer, substitute, and/or additional steps are within the purview of the invention and will be readily apparent to those of skill in the art. At 600, at a first satellite, a first portion of a frequency band is transmitted in a dispersed beam through a secondary reflector. The secondary reflector forms a portion of an illuminating reflector. At 605, a second portion of the frequency band is reflected from the secondary reflector. At 610, the second portion of the frequency band is received at a primary reflector. The primary reflector forms another portion of the illuminating reflector. At 620, the primary reflector reflects the second portion of the frequency band to form a substantially collimated beam. At 625, a second satellite acquires the dispersed beam and tracks the dispersed beam to acquire the collimated beam. At 630, the second satellite transmits a beacon signal to the first satellite to indicate acquisition of the collimated beam. At 635, the first satellite modulates the first frequency band in response to receiving the beacon signal. According to one embodiment, prior to receiving the beacon signal (i.e., prior to acquiring the collimated beam), the first satellite does not modulate the first frequency band.

Figure 7:
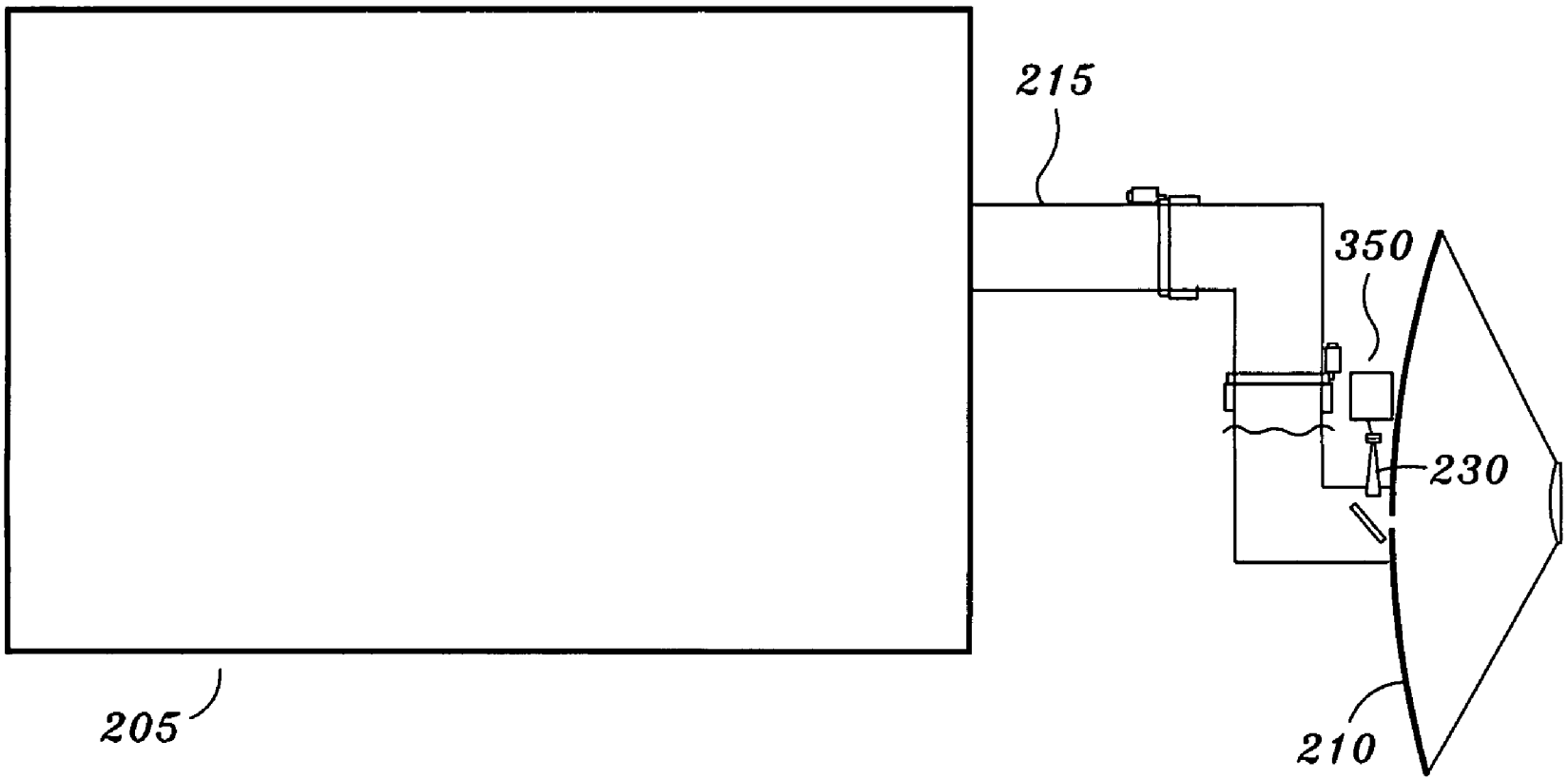
FIG. 7 is a simplified schematic of a satellite according to another embodiment of the present invention.

It should also be understood that the examples and embodiments described herein are for illustrative purposes only and that various modifications or changes in view thereof will be suggested to persons skilled in the art and are to be included within the spirit and purview of this application and scope of the appended claims. For example, while embodiments herein are described as transmitting first and second frequency bands, more than two frequency bands may be transmitted by illuminating reflectors described herein. Also, while one of the frequency bands is described as being transmitted in a collimated and dispersed beam, more than one frequency band may be similarly transmitted. Moreover, those of skill in the art will readily understand that the illuminating reflectors described herein may also be configured to collect frequency bands transmitted by other satellites as well as terrestrial transmitters and that the control electronics may be configured to demodulate and decode such transmissions. Moreover, while the control electronics and feed horn 230 are shown as being disposed in the satellite bus, these modules may be disposed outside of the bus, such as adjacent to illuminating reflector 210 as shown in FIG. 7. In the embodiment shown in FIG. 7, the control electronics and feed horns may be mounted on the control arm, the backside of the reflector or other structure. According to the embodiment shown in FIG. 7, control arm 215 might not include a waveguide, but might be gimbaled for illuminating reflector control. According to another embodiment, control arm 215 may include a waveguide to direct additional frequency bands (e.g., in addition to the frequency band described above) between the satellite bus and illuminating reflector 210. Therefore, the above description should not be taken as limiting the scope of the invention as defined by the claims. All publications, patents, and patent applications cited herein are hereby incorporated by reference for all purposes in their entirety.

What is claimed is:

1. An illuminating-reflector system for transmitting a frequency band in a dispersed beam and a substantially collimated beam, the system comprising:

a secondary reflector configured to transmit a first portion of the frequency band to form the dispersed beam and to reflect a second portion of the frequency band; and a primary reflector configured to receive the second portion of the frequency band reflected from the secondary reflector and to reflect the second portion of the frequency band to form the substantially collimated beam.

2. The system of claim 1, further comprising a dispersive lens configured to receive the frequency band and transmit the frequency band to the secondary reflector in another dispersed beam.

3. The system of claim 2, wherein the primary reflector includes an aperture formed therein to pass the frequency band from the dispersive lens to the secondary reflector.

4. The system of claim 2, wherein the dispersive lens is configured to receive the frequency band from a beam waveguide.

5. The system of claim 1, wherein the first portion includes about twenty percent or less of the power of the frequency band.

6. The system of claim 1, wherein the second portion includes about eighty or more of the power of the frequency band.

7. The system of claim 1 wherein the frequency band includes a V-band or a W-band.

8. The system of claim 7, wherein the V-band and the W-band respectively include a Military Satellite Communications V-band and a Military Satellite Communications W-band.

9. The system of claim 1 wherein the primary reflector has a diameter greater than or equal to about six feet and less than or equal to about eight feet.

10. The system of claim 1, wherein the secondary reflector has a diameter of greater than or equal to about 8 inches.

11. The system of claim 10, wherein the secondary reflector has a diameter of about 12 inches.

12. The system of claim 1, wherein the secondary reflector is a compound optical element.

13. The system of claim 1, wherein a gain of the primary reflector is greater than or equal to about 50 dBi.

14. The system of claim 1, wherein a gain of the primary reflector is about 59.5 dBi.

15. The system to claim 1, wherein a gain of the secondary reflector is less than or equal to about −33 dBi below the primary beam.

16. The system of claim 1, further comprising control electronics disposed in a satellite bus and configured to control a transmission direction of the dispersed beam and the substantially collimated beam.

17. The system of claim 1, wherein the dispersed beam is configured to be acquired by a satellite for initial acquisition and automatic tracking of the system.

18. A satellite for cross-link communications with at least one other satellite, the satellite comprising:

an illuminating reflector configured to transmit a first portion of a frequency band in a collimated beam and a second portion of a frequency band in a dispersed beam, wherein the illuminating reflector includes:

a secondary reflector configured to transmit the first portion of the frequency band to form the dispersed beam and to reflect a second portion of the frequency band; and a primary reflector configured to receive the second portion of the frequency band reflected from the secondary reflector and to reflect the second portion of the frequency band to form the substantially collimated beam.

19. The satellite of claim 18, wherein the dispersed beam is a low-gain beam.

20. The satellite of claim 18, wherein the collimated beam is a high-gain beam.

21. The satellite of claim 18, wherein the dispersed beam is configured to be acquired to another satellite for initial acquisition and automatic tracking of the first-mentioned satellite.

22. The satellite of claim 18, further comprising a dispersive lens configured to receive the frequency band from a beam waveguide and transmit the frequency band to the secondary reflector.

23. The satellite of claim 22, wherein the primary reflector includes an aperture formed therein to pass the frequency band transmitted from the dispersive lens to the secondary reflector.

24. The satellite of claim 22, wherein the dispersive lens configured to receive the frequency band from a beam waveguide.

25. The satellite of claim 22, wherein the first portion includes about five percent or less of the power of the frequency band transmitted from the dispersive lens.

26. The satellite of claim 22, wherein the second portion includes about ninety-five percent or more of the power of the frequency band transmitted from the dispersive lens.

27. The satellite of claim 18, wherein the frequency band includes a W-band.

28. The satellite of claim 27, wherein the W-band includes a Military Satellite Communications W-band.

29. The satellite of claim 18, wherein the primary reflector has a diameter greater than or equal to about six feet and less than or equal to about eight feet.

30. The satellite of claim 18, wherein the secondary reflector has a diameter greater than or equal to about eight inches.

31. The satellite of claim 18, wherein a gain of the primary reflector is greater than or equal to about 59 dBi.

32. The satellite of claim 31, wherein the gain of the primary reflector is about 59.5 dBi.

33. The satellite of claim 18, wherein a gain of the secondary reflector is less than or equal to about −33 dBi below the primary beam.

34. The satellite of claim 18, further comprising a satellite bus operatively coupled to the illuminating reflector.

35. The satellite of claim 34, further comprising control electronics disposed in the satellite bus and configured to slew the illuminating reflector.

36. A satellite communication method for cross-linked communication between satellites, the method comprising:

at a first satellite:

transmitting in a dispersed beam a first portion of a frequency band through a secondary reflector, wherein the secondary reflector is configured to form a portion of an illuminating reflector;

reflecting a second portion of the frequency band from the secondary reflector;

receiving at a primary reflector the second portion of the frequency band reflected from the secondary reflector, wherein the primary reflector is configured to form another portion of the illuminating reflector; and reflecting at the primary reflector the second portion of the frequency band to form a substantially collimated beam.

37. The method of claim 36, wherein the primary reflector and the secondary reflector form a Cassergrain reflector.

38. The method of claim 36, further comprising:

at a second satellite:

acquiring the dispersed beam; and tracking the dispersed beam to acquire the collimated beam.

39. The method of claim 38, further comprising transmitting a beacon signal from the second satellite to the first satellite to indicate acquisition of the collimated beam.

40. The method of claim 39, further comprising modulating the collimated beam for communications in response to receiving the beacon signal.

41. The method of claim 38, wherein the frequency band is un-modulated prior to acquisition of the collimated beam by the second satellite.

* * * * *